US009919897B2

(12) United States Patent
Aguado et al.

(10) Patent No.: US 9,919,897 B2
(45) Date of Patent: Mar. 20, 2018

(54) GOVERNOR FOR CONTROLLING THE SPEED OF A HOISTED OBJECT RELATIVE TO A GUIDE MEMBER

(71) Applicant: Otis Elevator Company, Farmington, CT (US)

(72) Inventors: Jose Miguel Aguado, Madrid (ES); Jesus Canizares, Madrid (ES); Andres Monzon, Madrid (ES); Juan Jose Fernandez, Madrid (ES); Luis Marti, Madrid (ES); Javier Narrillos, Madrid (ES)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 15/114,678

(22) PCT Filed: Feb. 22, 2015

(86) PCT No.: PCT/US2015/016994
§ 371 (c)(1),
(2) Date: Jul. 27, 2016

(87) PCT Pub. No.: WO2015/130577
PCT Pub. Date: Sep. 3, 2015

(65) Prior Publication Data

US 2016/0362277 A1 Dec. 15, 2016

(30) Foreign Application Priority Data

Feb. 26, 2014 (EP) ..... 14382067

(51) Int. Cl.
*B66B 5/04* (2006.01)

(52) U.S. Cl.
CPC ..... *B66B 5/044* (2013.01)

(58) Field of Classification Search
CPC ..... B66B 5/04; B66B 5/044
See application file for complete search history.

(56) References Cited

U.S. PATENT DOCUMENTS 2,072,852 A * 3/1937 Batten ..... F16D 13/18 188/323
2,588,482 A * 3/1952 Chapman ..... F16D 43/18 192/105 CD (Continued)

FOREIGN PATENT DOCUMENTS

EP 1944262 A1 7/2008
FR 2808517 A1 11/2001

*Primary Examiner* — Michael A Riegelman
(74) *Attorney, Agent, or Firm* — O'Shea Getz P.C.

(57) ABSTRACT

A governor includes a housing, a pulley, a belt, a first flyweight, and second flyweight. The housing defines a housing cavity. The pulley is disposed at least partially within the housing cavity. The belt is in contact with the pulley. The belt is operable to rotate the pulley at a rotational speed. The first and second flyweights are pivotably connected to the pulley, and are biased towards one another. At least a portion of the first and second flyweights are operable to move away from the pulley when the rotational speed of the pulley is increasing toward a predetermined threshold rotational speed. The first and second flyweights are operable to contact the housing, and thereby transmit rotational energy to the housing, when the rotational speed of the pulley is equal to at least the predetermined threshold rotational speed.

15 Claims, 5 Drawing Sheets

(56) References Cited

U.S. PATENT DOCUMENTS

| | | | | | |
|---|---|---|---|---|---|
| 2,673,633 | A | * | 3/1954 | Miller | F16D 43/22 192/104 R |
| 3,024,886 | A | * | 3/1962 | Peras | F16D 43/18 192/105 CE |
| 3,208,571 | A | * | 9/1965 | Bochory | F16D 43/18 192/105 CD |
| 3,415,343 | A | | 12/1968 | Torbjorn et al. | |
| 3,908,801 | A | | 9/1975 | Pohlman | |
| 4,556,155 | A | * | 12/1985 | Koppensteiner | B66B 5/044 187/305 |
| 4,856,623 | A | | 8/1989 | Romig, Jr. | |
| 5,052,523 | A | | 10/1991 | Ericson | |
| 5,065,845 | A | | 11/1991 | Pearson | |
| 5,197,571 | A | | 3/1993 | Burrell et al. | |
| 5,217,091 | A | | 6/1993 | Shiina et al. | |
| 5,222,578 | A | | 6/1993 | Thorp | |
| 5,299,661 | A | | 4/1994 | Pramanik et al. | |
| 5,310,022 | A | | 5/1994 | Sheridan et al. | |
| 5,377,786 | A | | 1/1995 | Nakagawa | |
| 5,458,216 | A | | 10/1995 | Tanaka et al. | |
| 5,492,200 | A | * | 2/1996 | Korhonen | B66B 5/044 187/350 |
| 5,617,933 | A | | 4/1997 | Ericson | |
| 5,848,781 | A | | 12/1998 | Kulhavy et al. | |
| 6,318,507 | B1 | | 11/2001 | Jin | |
| 6,457,569 | B2 | | 10/2002 | Draper et al. | |
| 6,830,132 | B1 | | 12/2004 | Kang et al. | |
| 7,077,246 | B2 | | 7/2006 | Timtner | |
| 8,136,795 | B2 | | 3/2012 | Dube | |
| 8,453,799 | B2 | | 6/2013 | Muller et al. | |
| 2003/0042079 | A1 | * | 3/2003 | Sanchez | B60T 1/062 187/373 |
| 2010/0059319 | A1 | * | 3/2010 | Aguado | B66B 5/044 187/414 |
| 2011/0272217 | A1 | * | 11/2011 | Niikawa | B66B 5/044 187/305 |
| 2012/0103732 | A1 | | 5/2012 | Kwon | |
| 2013/0098711 | A1 | | 4/2013 | Aguado et al. | |
| 2013/0306409 | A1 | * | 11/2013 | Dube | B66B 5/044 187/287 |

* cited by examiner

GOVERNOR FOR CONTROLLING THE SPEED OF A HOISTED OBJECT RELATIVE TO A GUIDE MEMBER

This application claims priority to PCT Patent Application No. PCT/US2015/016994 filed Feb. 22, 2015, which claims priority to EP14382067.8 filed Feb. 26, 2014, both of which are hereby incorporated herein by reference in their entireties.

BACKGROUND

1. Technical Field

Aspects of the present invention relate to a governor, and more particularly relate to a governor that is operable to aid in controlling the speed of a hoisted object relative to a guide member.

2. Background Information

It is known to provide a governor that is operable to aid in controlling the speed of a hoisted object (e.g., an elevator car, a counterweight) relative to a guide member (e.g., a rail). In some instances, the governor includes one or more rotatable components that are rotated by a tension member (e.g., a rope) that is made at least substantially of one or more metallic materials (e.g., steel). In some instances, the rotatable components are made at least substantially of one or more metallic materials (e.g., steel, cast iron) to aid in reducing the amount of wear experienced by the rotatable components and the tension member as a result of contact there between. The rotatable components and the tension member, being made at least substantially of one or more metallic materials, can cause the governor to have an undesirably high weight, and thus can reduce the overall efficiency of the hoisting system. In some instances, the governor can additionally or alternatively be undesirably large in size. In some instances, the governor can additionally or alternatively be configured such that it lacks the sensitivity necessary to accurately control the speed of the hoisted object when the hoisted object is moving at relatively low speeds relative to the guide member. Aspects of the present invention are directed to these and other problems.

SUMMARY OF ASPECTS OF THE INVENTION

According to an aspect of the present invention, a governor is provided that is operable to aid in controlling speed of a hoisted object relative to a guide member. The governor includes a housing, a pulley, a belt, a first flyweight, and second flyweight. The housing defines a housing cavity. The pulley is disposed at least partially within the housing cavity. The belt is in contact with the pulley. The belt is operable to rotate the pulley at a rotational speed related to speed of the hoisted object relative to the guide member. The first and second flyweights are pivotably connected to the pulley, and are biased towards one another. At least a portion of the first and second flyweights are operable to move away from the pulley when the rotational speed of the pulley is increasing toward a predetermined threshold rotational speed. The first and second flyweights are operable to contact the housing, and thereby transmit rotational energy to the housing, when the rotational speed of the pulley is equal to at least the predetermined threshold rotational speed.

According to another aspect of the present invention, a hoisting system is provided that includes a governor that is operable to aid in controlling speed of a hoisted object relative to a guide member. The governor includes a housing, a pulley, a belt, a first flyweight, and second flyweight.

The housing defines a housing cavity. The pulley is disposed at least partially within the housing cavity. The belt is in contact with the pulley. The belt is operable to rotate the pulley at a rotational speed related to speed of the hoisted object relative to the guide member. The first and second flyweights are pivotably connected to the pulley, and are biased towards one another. At least a portion of the first and second flyweights are operable to move away from the pulley when the rotational speed of the pulley is increasing toward a predetermined threshold rotational speed. The first and second flyweights are operable to contact the housing, and thereby transmit rotational energy to the housing, when the rotational speed of the pulley is equal to at least the predetermined threshold rotational speed.

Additionally or alternatively, the present invention may include one or more of the following features individually or in combination:

the belt is made at least substantially of non-metallic material;

the belt is made at least substantially of plastic;

the belt is made at least substantially of rubber;

the belt is made at least substantially of plastic and rubber;

the belt extends between a first end connected to a hoistway ceiling, and a second end connected to a hoistway floor;

the pulley includes a plurality of pulley teeth, the belt includes a plurality of belt teeth, and the pulley teeth and the belt teeth are operable to mate with one another;

the pulley includes a pulley shaft, a pulley base, and an aperture extending through the pulley shaft and the pulley base along an axial centerline of the pulley, and the pulley shaft extends axially from the pulley base, the pulley shaft extends annularly about the axial centerline of the pulley, and a radially outer surface of the pulley shaft defines the plurality of pulley teeth;

the housing includes a housing wall, a housing base, and an aperture extending through the housing base along an axial centerline of the housing, the housing wall extends axially from a radially outer portion of the housing base, and extends annularly about the axial centerline of the housing, and the housing wall extends radially between an inner surface and an outer surface, the inner surface defining the housing cavity;

the first and second flyweights are structurally identical to one another;

the first and second flyweights are operable to be disposed in a first position relative to the pulley when the rotational speed of the pulley is zero, the first and second flyweights are operable to move toward a second position relative to the pulley when the rotational speed of the pulley is increasing toward the predetermined threshold rotational speed, and the first and second flyweights are operable to be disposed in the second position, in which they contact the housing and thereby transmit rotational energy from the pulley to the housing, when the rotational speed of the pulley equal to at the predetermined threshold rotational speed;

centrifugal forces are operable act on the first and second flyweights, thereby causing the first and second flyweights to overcome bias there between, and thereby causing the first and second flyweights to move toward their respective second positions in a generally synchronized and symmetric manner, when the rotational speed of the pulley is increasing toward the predetermined threshold rotational speed;

a housing tooth defined by the inner surface of the housing wall is operable to mate with a flyweight tooth defined by a radially outer surface of at least one of the first and second flyweights when the first and second flyweights are disposed in their respective second positions;

the housing is operable to rotate with the first and second flyweights and the pulley, and thereby rotationally actuate a safety device, when the first and second flyweights transmit rotational energy from the pulley to the housing, and the safety device is operable to decrease the speed of the hoisted object relative to the rail;

the pulley is made at least substantially of non-metallic material;

the housing is made at least substantially of non-metallic material;

the hoisted object is an elevator car, and the guide member is a rail connected to a sidewall of a hoistway;

the belt is made at least substantially of non-metallic material;

These and other aspects of the present invention will become apparent in light of the drawings and detailed description provided below.

DETAILED DESCRIPTION OF ASPECTS OF THE INVENTION

Figure 1:
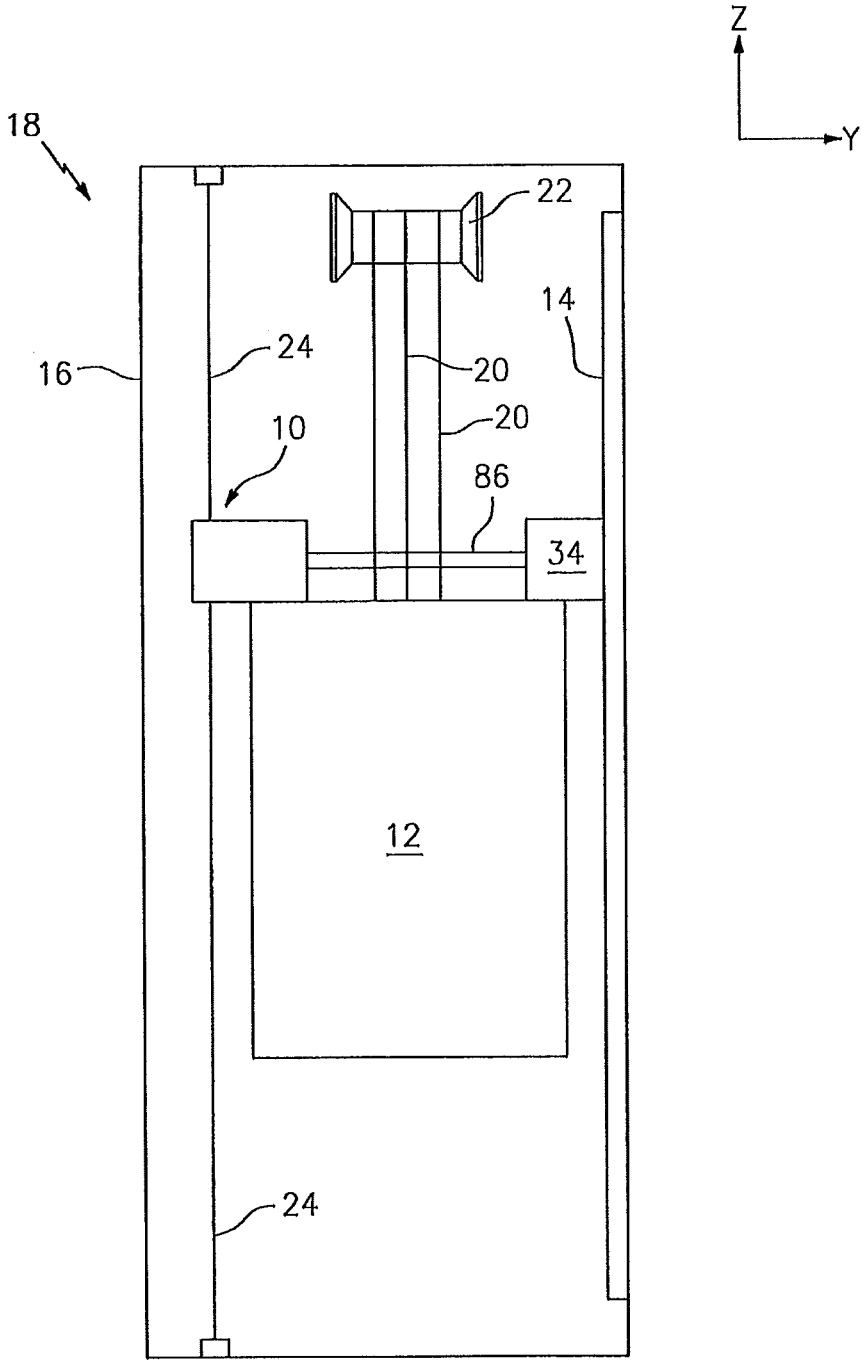
FIG. 1 illustrates a schematic view of an elevator system that includes a governor.

Referring to FIG. 1, the present disclosure describes embodiments of a governor 10 that is operable to aid in controlling the speed of a hoisted object 12 relative to a guide member 14. The present disclosure describes aspects of the present invention with reference to the exemplary embodiment illustrated in the drawings; however, aspects of the present invention are not limited to the exemplary embodiment illustrated in the drawings. The present disclosure may describe one or more features as having a length extending along a x-axis, a width extending along a y-axis, and/or a height extending along a z-axis. The drawings illustrate the respective axes.

The governor 10 can be used to aid in controlling the speed of various types of hoisted objects 12 (e.g., elevator cars, counterweights) relative to various types of guide members 14 (e.g., rails). Referring to FIG. 1, in the illustrated embodiment, the hoisted object 12 is an elevator car, and the guide member 14 is a rail that is connected to a sidewall of a hoistway 16. For ease of description, the hoisted object 12 and the guide member 14 will be referred to hereinafter as the "elevator car 12" and the "rail 14", respectively.

The governor 10, the elevator car 12, and the rail 14 can be included in elevator systems having various different configurations. In the elevator system 18 illustrated in FIG. 1, the elevator car 12 is connected to a counterweight (not shown) by a plurality of tension members 20, and the tension members 20 contact a sheave 22 that is operable to be selectively driven by a machine (not shown) to selectively move the elevator car 12 and the counterweight within the hoistway 16.

The governor 10 includes one or more components that are connected to the elevator car 12 such that the components move with the elevator car 12 when the elevator car 12 moves relative to the rail 14.

Referring to FIGS. 2-5, the governor 10 includes a belt 24 (see FIG. 2), a pulley 26, a housing 28, a first flyweight 30, and a second flyweight 32. The belt 24 contacts the pulley 26, and rotates the pulley 26 at a rotational speed that is related to the speed of the elevator car 12 relative to the rail 14. The pulley 26 is disposed at least partially within a housing cavity defined by the housing 28. The first and second flyweights 30, 32 are pivotably connected to the pulley 26. The governor 10 is configured such that when the rotational speed of the pulley 26 is increasing toward a predetermined threshold rotational speed, at least a portion of the first and second flyweights 30, 32 move away from the pulley 26. When the rotational speed of the pulley 26 is equal to or greater than the predetermined threshold rotational speed, the first and second flyweights 30, 32 contact the housing 28 and thereby transmit rotational energy to the housing 28.

The governor 10 can function in various different ways. Referring to FIGS. 2-5, in the illustrated embodiment, the governor 10 is configured such that when the rotational speed of the pulley 26 is zero (e.g., when the elevator car 12 (see FIG. 1) is stationary relative to the rail 14 (see FIG. 1)), the first and second flyweights 30, 32 are disposed in a first position (see FIG. 2) relative to the pulley 26. When the rotational speed of the pulley 26 is increasing toward the predetermined threshold rotational speed (e.g., when the speed of the elevator car 12 relative to the rail 14 is increasing towards a predetermined threshold elevator car speed), the first and second flyweights 30, 32 move toward a second position (see FIG. 3) relative to the pulley 26. When the rotational speed of the pulley 26 is equal to or greater than the predetermined threshold rotational speed (e.g., when the speed of the elevator car 12 relative to the rail 14 is equal to or greater than a predetermined threshold elevator car speed), the first and second flyweights 30, 32 are disposed in the second position (see FIG. 3), in which they contact the housing 28 and thereby transmit rotational energy from the pulley 26 to the housing 28. When the first and second flyweights 30, 32 transmit rotational energy from the pulley 26 to the housing 28, the housing 28 rotates with the first and second flyweights 30, 32 and the pulley 26 and thereby rotationally actuates a known safety device 34 (see FIG. 1) that is operable to decrease the speed of the elevator car 12 relative to the rail 14.

Figure 2:
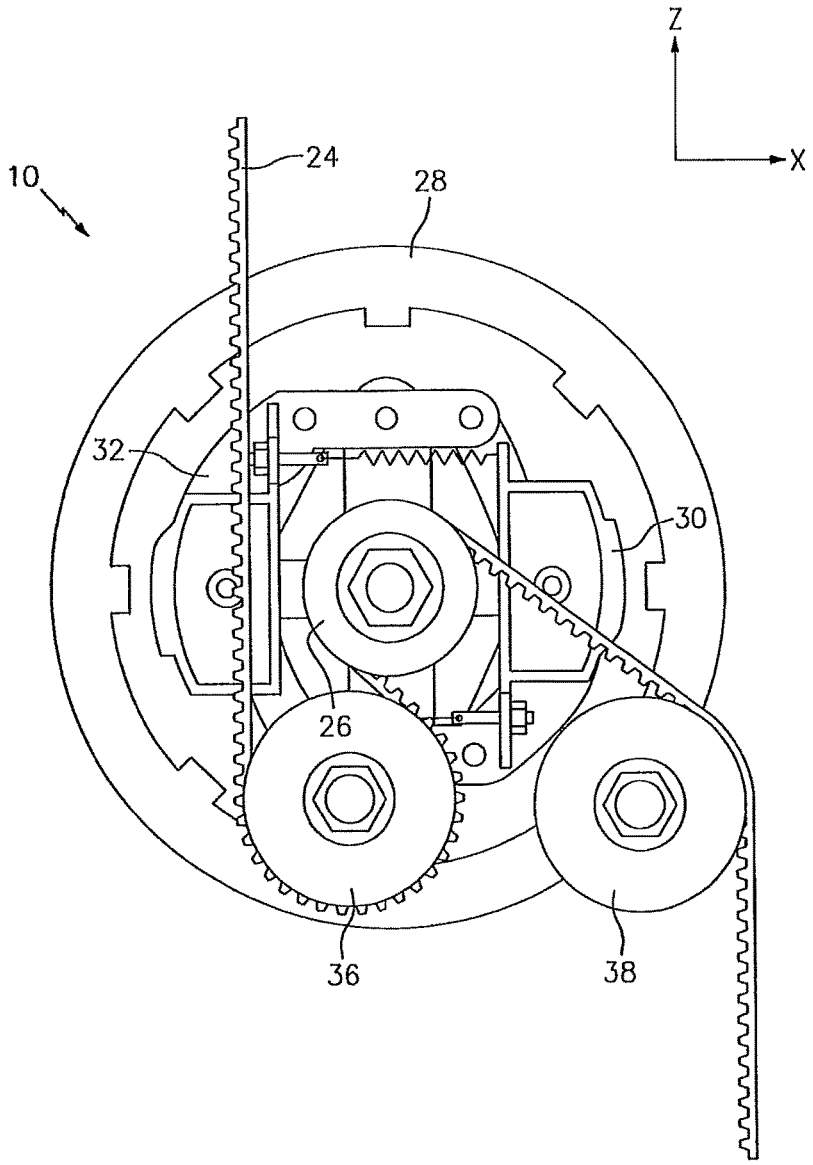
FIG. 2 illustrates a front elevation view of components of the governor of FIG. 1.

The belt 24 can be configured in various different ways. Referring to FIG. 1, in the illustrated embodiment, the belt 24 extends between a first end that is connected to the ceiling of a hoistway 16, and a second end that is connected to the floor of a hoistway 16. Referring to FIG. 2, in the illustrated embodiment, the belt 24 includes a plurality of belt teeth that are operable to contact the pulley 26, as will be discussed further below. The belt 24 additionally contacts a first idler sheave 36 and a second idler sheave 38 that are included in the governor 10. The governor 10 additionally includes an enclosure (not shown) that encloses a portion of the belt 24, the pulley 26, the housing 28, and the first and second flyweights 30, 32. The first and second idler sheaves 36, 38 are rotatably connected to the enclosure using first and second bearings (not shown), respectively. The first and second idler sheaves 36, 38 aid in aligning the belt 24 relative to the pulley 26. The belt 24 includes a plurality of steel belt wires (not shown) extending in a direction between the first and second ends of the belt 24, and a belt jacket (not shown) that encases the steel belt wires. The steel belt wires are collectively less voluminous than the steel wires that are typically included in steel elevator ropes. The belt jacket is made of a plastic material. The belt jacket is substantially more voluminous than the belt wires, and thus the belt 24 can be described as being made substantially of a non-metallic material (e.g., a plastic material). In some embodiments not shown in the drawings, the belt 24 is made entirely of non-metallic material (e.g., a plastic material, a rubber material, and various combinations thereof); the belt 24 can be in the form of a timing belt, a V-belt, or another type of belt; and/or the belt 24 can have various different profile shapes.

Figure 5:
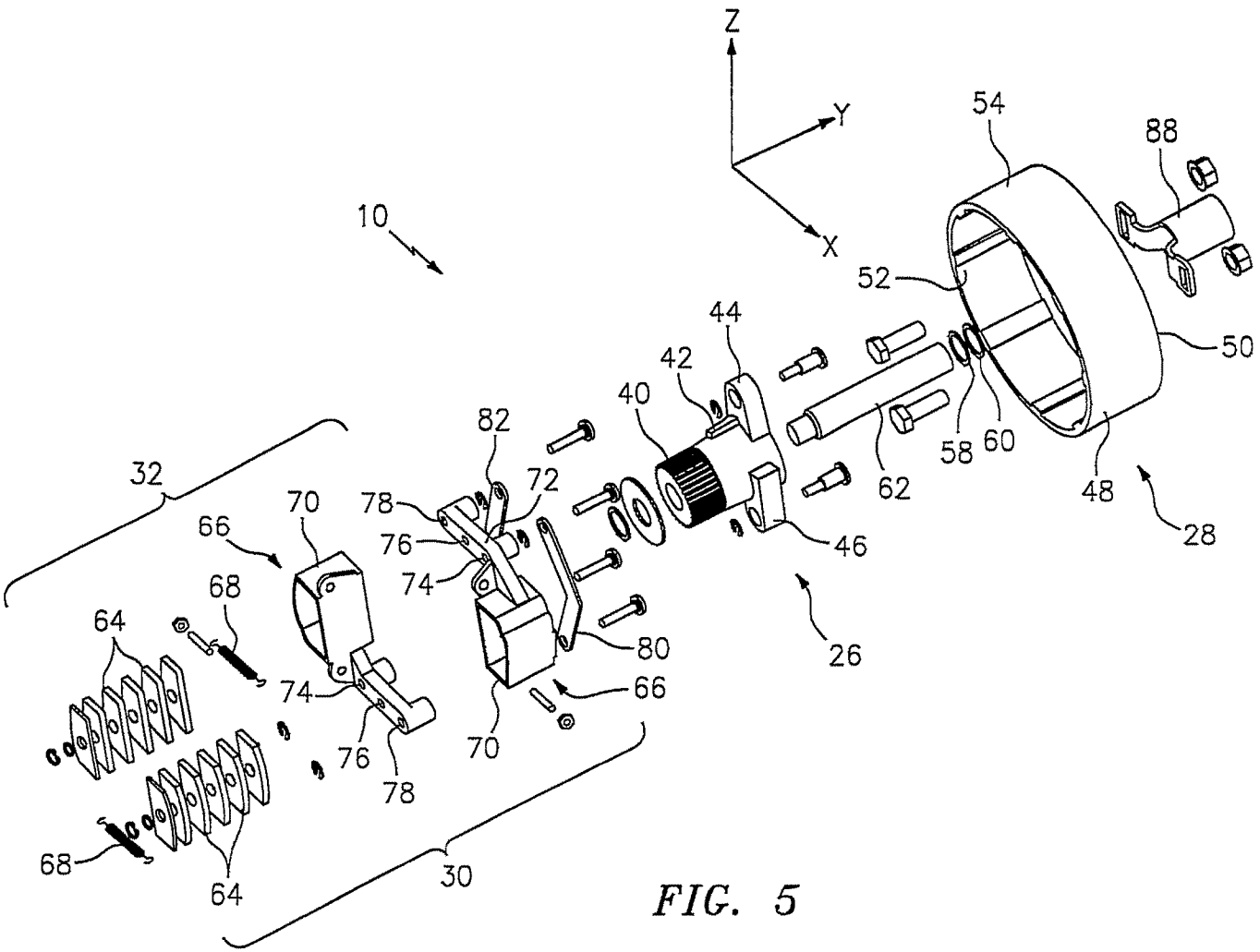
FIG. 5 illustrates an exploded perspective view of components of the governor of FIG. 1.

The pulley 26 can be configured in various different ways. Referring to FIG. 5, in the illustrated embodiment, the pulley 26 includes a pulley shaft 40 and a pulley base 42. The pulley 26 includes an aperture that extends through the pulley shaft 40 and the pulley base 42 along an axial centerline of the pulley 26. The pulley shaft 40 extends axially from the pulley base 42. The pulley shaft 40 extends annularly about the axial centerline of the pulley 26. The radially outer surface of the pulley shaft 40 defines a plurality of radially-extending pulley teeth that are operable to mate with the belt teeth of the belt 24 (see FIGS. 1 and 2). The pulley base 42 includes a radially-extending first flange 44, and a radially-extending second flange 46 disposed circumferentially opposite the first flange 44. The first and second flanges 44, 46 each include an aperture that extends axially there through. The pulley 26 is made of a plastic material. In some embodiments not shown in the drawings, the pulley 26 can be made at least partially of one or more other non-metallic materials (e.g., plastic materials, rubber materials, and various combinations thereof) and/or one or more metallic materials (e.g., cast iron, steel, and various combinations thereof).

The housing 28 can be configured in various different ways. Referring to FIG. 5, in the illustrated embodiment, the housing 28 includes a housing wall 48 and a disc-shaped housing base 50. The housing 28 includes an aperture that extends through the housing base 50 along an axial centerline of the housing 28. The housing wall 48 extends axially from a radially outer portion of the housing base 50. The housing wall 48 extends annularly about the axial centerline of the housing 28. The housing wall 48 extends radially between an inner surface 52 and an outer surface 54. The inner surface 52 of the housing wall 48 defines a housing cavity within which the pulley 26 is partially disposed. The inner surface 52 of the housing wall 48 defines a plurality of radially-extending housing teeth 56 (see FIG. 3). In some embodiments not shown in the drawings, the housing 28 can be made at least partially of one or more other non-metallic materials (e.g., plastic materials, rubber materials, and various combinations thereof) and/or one or more metallic materials (e.g., cast iron, steel, and various combinations thereof).

The pulley 26 and the housing 28 can be configured relative to one another in various different ways. Referring to FIG. 5, in the illustrated embodiment, the pulley 26 is rotatably connected to the housing base 50. The governor 10 additionally includes first and second retaining rings 58, 60 and a mounting shaft 62. The first and second retaining rings 58, 60 are seated within the aperture that extends through the housing base 50. The mounting shaft 62 extends along an axial centerline, between a first end portion and a second end portion. The first end portion of the mounting shaft 62 is rotatably connected to the housing base 50 via the first and second retaining rings 58, 60. The second end portion of the mounting shaft 62 is positionally fixed within the aperture of the pulley 26 to thereby rotatably connect the pulley 26 to the housing base 50. The pulley 26, the housing 28, and the mounting shaft 62 are positioned relative to one another such that their respective centerlines are aligned with one another.

The first and second flyweights 30, 32 can be configured in various different ways. Referring to FIG. 5, in the illustrated embodiment, the first and second flyweights 30, 32 are structurally identical to one another. The first and second flyweights 30, 32 each comprise six (6) flyweight loads 64, a flyweight load carrier 66, and a flyweight biaser 68 (e.g., a tension spring). Each of the flyweight loads 64 has at least substantially the same weight. The flyweight load carrier 66 includes a mounting portion 70 and a lever portion 72. The mounting portion 70 and the lever portion 72 of the flyweight load carrier 66 are disposed relative to one another such that the flyweight load carrier 66 is generally L-shaped. The mounting portion 70 of the flyweight load carrier 66 forms a housing cavity within which the flyweight loads 64 are positionally fixed relative to the flyweight load carrier 66. The lever portion 72 includes an inner aperture 74 that extends axially there through, a middle aperture 76 that extends axially there through, and an outer aperture 78 that extends axially there through.

The first and second flyweights 30, 32 and the pulley 26 can be configured relative to one another in various different ways. Referring to FIG. 5, in the illustrated embodiment, the governor 10 additionally includes first and second brackets 80, 82, and various connectors (e.g., bolts, screws). Each of the first and second brackets 80, 82 is generally V-shaped, and extends between a first end portion and a second end portion. The first end portion of each of the first and second brackets 80, 82 includes an aperture that extends axially there through. The second end portion of each of the first and second brackets 80, 82 includes an aperture that extends axially there through. The aperture in the first flange 44 of the pulley base 42 is aligned with the middle aperture 76 in the lever portion 72 of the first flyweight 30. The aperture in the second flange 46 of the pulley base 42 is aligned with the middle aperture 76 in the lever portion 72 of the second flyweight 32. The apertures in the first end portions of the first and second brackets 80, 82 are aligned with the inner and outer apertures 74, 78 in the lever portion 72 of the first flyweight 30, respectively. The apertures in the second end portions of the first and second brackets 80, 82 are aligned with the inner and outer apertures 74, 78 in the lever portion 72 of the second flyweight 32, respectively. The various connectors extend through the above-described apertures to connect the first and second flyweights 30, 32, the first and second brackets 80, 82, and the pulley 26. The flyweight biaser 68 (also see FIG. 3) of each of the first and second flyweights 30, 32 connects the respective flyweight 30, 32 to the other flyweight 30, 32. Each flyweight biaser 68 extends between a first flange disposed proximate the junction of the lever portion 72 and the mounting portion 70 of the flyweight load carrier 66 of the respective flyweight 30, 32, and a second flange disposed proximate a distal end of the mounting portion 70 of the flyweight load carrier 66 of the other flyweight 30, 32. Each of the first and second flyweights 30, 32 is operable to pivot relative to the pulley 26 about an axis that extends through the middle aperture 76 in the lever portion 72 of the respective flyweight load carrier 66. The first and second flyweights 30, 32 collectively define a generally parallelogram-shaped area there between. When the first and second flyweights 30, 32 are moving from the first position (see FIG. 2) toward the second position (see FIG. 3), the area defined between the first and second flyweights 30, 32 will change between different parallelogram-like shapes, but the size of the area will remain at least substantially constant.

Figure 3:
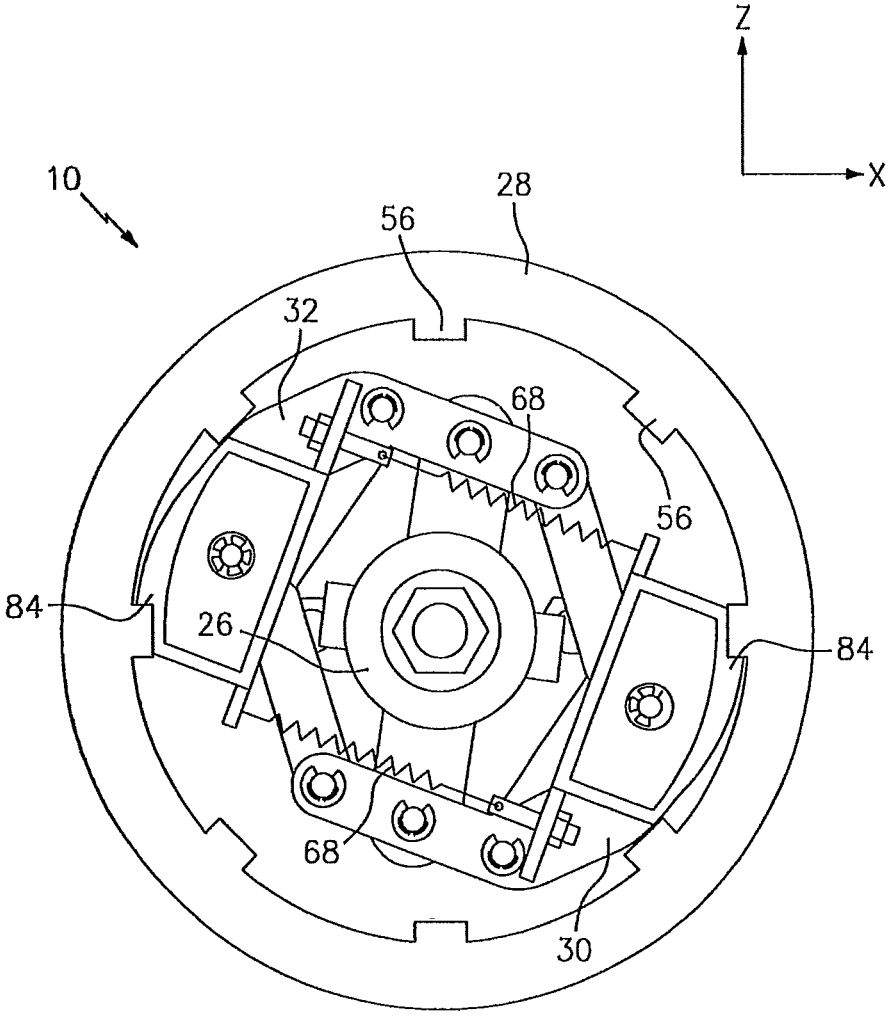
FIG. 3 illustrates a front elevation view of components of the governor of FIG. 1.

Referring to FIGS. 2 and 3, in the illustrated embodiment, when the rotational speed of the pulley 26 is zero, each of the first and second flyweights 30, 32 are disposed in a first position (see FIG. 2) relative to the pulley 26. When the rotational speed of the pulley 26 is increasing toward the predetermined threshold rotational speed, the first and second flyweights 30, 32 move toward a second position (see FIG. 3) relative to the pulley 26. When the rotational speed of the pulley 26 is equal to or greater than the predetermined threshold rotational speed, the first and second flyweights 30, 32 are disposed in the second position (see FIG. 3). When the rotational speed of the pulley 26 is increasing toward the predetermined threshold rotational speed, centrifugal forces will act on the first and second flyweights 30, 32, thereby causing them to overcome the bias provided by the flyweight biasers 68, and thereby causing them to move toward their respective second positions (see FIG. 3) in a generally synchronized and symmetric manner. When the first and second flyweights 30, 32 are disposed in the first position (see FIG. 2), or when the first and second flyweights 30, 32 are moving from the first position (see FIG. 2) toward the second position (see FIG. 3), a radial distance will extend between the inner surface 52 of the housing wall 48 and a flyweight tooth 84 (see FIG. 3) disposed on a radially outer surface of the mounting portion 70 of the respective flyweight load carrier 66. When the first and second flyweights 30, 32 are disposed in the second position (see FIG. 3), one or more of the plurality of housing teeth 56 (see FIG. 3) defined by the inner surface 52 of the housing wall 48 will mate with one or both of the flyweight teeth 84 (see FIG. 3). When the first and second flyweights 30, 32 are disposed in the second position (see FIG. 3), rotational energy is transmitted from the pulley 26 to the housing 28 via the first and second flyweights 30, 32 as a result of the mating of the housing teeth 56 (see FIG. 3) and the flyweight teeth 84 (see FIG. 3). When the first and second flyweights 30, 32 transmit rotational energy from the pulley 26 to the housing 28, the housing 28 rotates and thereby rotationally actuates a safety device 34 (see FIG. 1) that is operable decrease the speed of the elevator car 12 relative to the rail 14. The housing 28 is connected to the safety device 34 via a rotatable shaft 86 (see FIG. 1), and the rotatable shaft 86 is connected to the housing base 50 via a connector 88 (see FIG. 5). By rotationally actuating the safety device 34, the governor 10 is thereby operable to control the speed of the elevator car 12 relative to the rail 14.

The sizes, the relative sizes, and/or the ranges of sizes of components of the governor 10 can vary depending on the application.

The speeds, the relative speeds, and/or the ranges of speeds at which components of the governor 10 move and/or rotate can vary depending on the application.

Figure 4:
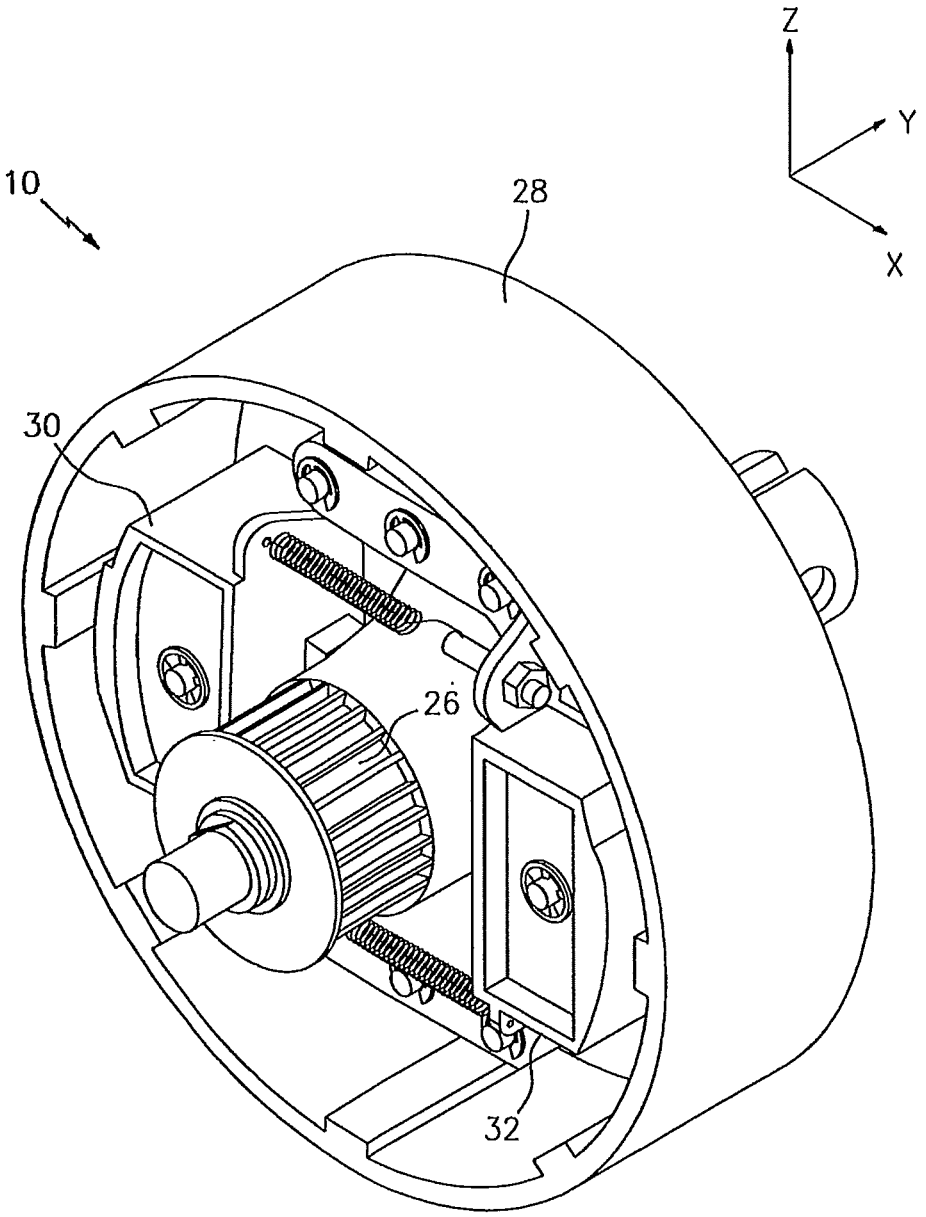
FIG. 4 illustrates a perspective view of components of the governor of FIG. 1.

Referring to FIG. 2, the governor 10 can be advantageous for various different reasons. First, the governor 10 can weigh significantly less than prior art governors. Second, the components of the governor 10 can experience significantly less wear, and thus can last longer, than components of prior art governors. These first and second advantages are due at least in part to the fact that the belt 24, the pulley 26, and/or the housing 28 can be made at least substantially of non-metallic materials, as opposed to metallic materials. Third, the governor 10 can be significantly smaller in size than prior art governors. Referring to FIG. 4, in the illustrated embodiment, the positioning of the pulley 26 within the housing cavity defined by the housing 28 permits the governor 10 to be significantly more compact than prior art governors. Fourth, because the governor 10 can be significantly smaller in size than prior art governors, it can control the speed of the elevator car 12 at lower speeds more accurately than prior art governors.

While several embodiments have been disclosed, it will be apparent to those of ordinary skill in the art that aspects of the present invention include many more embodiments. Accordingly, aspects of the present invention are not to be restricted except in light of the attached claims and their equivalents. It will also be apparent to those of ordinary skill in the art that modifications can be made without departing from the scope of the present disclosure. For example, in some instances, one or more features disclosed in connection with one embodiment can be used alone or in combination with one or more features of another embodiment.

What is claimed is:

1. A governor operable to aid in controlling speed of a hoisted object relative to a guide member, the governor comprising:

a housing defining a housing cavity;

a pulley disposed at least partially within the housing cavity;

a belt in contact with the pulley, the belt being operable to rotate the pulley at a rotational speed related to speed of the hoisted object relative to the guide member;

a first flyweight and a second flyweight, the first and second flyweights being pivotably connected to the pulley, and being biased towards one another;

wherein at least a portion of the first and second flyweights are operable to move away from the pulley when the rotational speed of the pulley is increasing toward a predetermined threshold rotational speed; and wherein the first and second flyweights are operable to contact the housing, and thereby transmit rotational energy to the housing, when the rotational speed of the pulley is equal to at least the predetermined threshold rotational speed.

2. The governor of claim 1, wherein the belt is made at least substantially of non-metallic material.

3. The governor of claim 1, wherein the belt is made at least substantially of plastic.

4. The governor of claim 1, wherein the belt is made at least substantially of rubber.

5. The governor of claim 1, wherein the belt is made at least substantially of plastic and rubber.

6. The governor of claim 1, wherein the belt extends between a first end connected to a hoistway ceiling, and a second end connected to a hoistway floor.

7. The governor of claim 1, wherein the pulley includes a plurality of pulley teeth, the belt includes a plurality of belt teeth, and the pulley teeth and the belt teeth are operable to mate with one another.

8. The governor of claim 7, wherein the pulley includes a pulley shaft, a pulley base, and an aperture extending through the pulley shaft and the pulley base along an axial centerline of the pulley; and wherein the pulley shaft extends axially from the pulley base, the pulley shaft extends annularly about the axial centerline of the pulley, and a radially outer surface of the pulley shaft defines the plurality of pulley teeth.

9. The governor of claim 1, wherein the housing includes a housing wall, a housing base, and an aperture extending through the housing base along an axial centerline of the housing;

wherein the housing wall extends axially from a radially outer portion of the housing base, and extends annularly about the axial centerline of the housing;

wherein the housing wall extends radially between an inner surface and an outer surface, the inner surface defining the housing cavity.

10. The governor of claim 1, wherein the first and second flyweights are structurally identical to one another.

11. The governor of claim 1, wherein the first and second flyweights are operable to be disposed in a first position relative to the pulley when the rotational speed of the pulley is zero, the first and second flyweights are operable to move toward a second position relative to the pulley when the rotational speed of the pulley is increasing toward the predetermined threshold rotational speed, and the first and second flyweights are operable to be disposed in the second position, in which they contact the housing and thereby transmit rotational energy from the pulley to the housing, when the rotational speed of the pulley equal to at the predetermined threshold rotational speed.

12. The governor of claim 11, wherein centrifugal forces are operable to act on the first and second flyweights, thereby causing the first and second flyweights to overcome bias there between, and thereby causing the first and second flyweights to move toward their respective second positions in a generally synchronized and symmetric manner, when the rotational speed of the pulley is increasing toward the predetermined threshold rotational speed.

13. The governor of claim 11, wherein a housing tooth defined by the inner surface of the housing wall is operable to mate with a flyweight tooth defined by a radially outer surface of at least one of the first and second flyweights when the first and second flyweights are disposed in their respective second positions.

14. The governor of claim 1, wherein the housing is operable to rotate with the first and second flyweights and the pulley, and thereby rotationally actuate a safety device, when the first and second flyweights transmit rotational energy from the pulley to the housing; and wherein the safety device is operable to decrease the speed of the hoisted object relative to the rail.

15. The governor of claim 1, wherein at least one of the pulley and the housing is made at least substantially of non-metallic material.

* * * * *